US006431359B1

(12) United States Patent
Hollander

(10) Patent No.: US 6,431,359 B1
(45) **Date of Patent: *Aug. 13, 2002**

(54) MULTI-VIEW PACKAGING MATERIAL

(76) Inventor: Milton Bernard Hollander, One Arbor Rd., Stamford, CT (US) 06907

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/102,213

(22) Filed: Jun. 22, 1998

Related U.S. Application Data

(60) Provisional application No. 60/050,556, filed on Jun. 23, 1997.

(51) Int. Cl.[7] ..... B65D 85/00

(52) U.S. Cl. ..... 206/459.5; 206/576; 206/320; 40/312

(58) Field of Search ..... 206/459.5, 316.1, 206/316.2, 316.3, 576, 534, 775, 776; 40/312

(56) References Cited

U.S. PATENT DOCUMENTS 4,648,548 A * 3/1987 Shin ..... 206/459.5
4,953,779 A * 9/1990 Densen ..... 206/459.5
5,246,161 A * 9/1993 Kapp ..... 206/459.5
5,582,293 A * 12/1996 Kay ..... 206/459.5
5,622,264 A * 4/1997 Wetterlund ..... 206/459.5
5,641,062 A * 6/1997 Burton et al. ..... 206/459.5
5,725,382 A * 3/1998 Walter et al. ..... 206/459.5

OTHER PUBLICATIONS

10 Cup Coffeemaker, Aromaster KF 420B, Braun Inc.*

* cited by examiner

*Primary Examiner*—Luan K. Bui
(74) *Attorney, Agent, or Firm*—William A. Drucker

(57) ABSTRACT

The invention provides packaging material, both in the form of self-sustaining, e.g. rigid sheeting, and in the form of wrapping material such as paper or plastics material, which impart to a package illustrations of the contents of the package when those contents are viewed from different angles, thereby to facilitate appreciation (without undoing or unwrapping the package) of the nature of the contents and particularly the appearance of the contents of the package when seen from more than one angle. In a simple form, a package comprises a cubic or otherwise rectangular rigid or semi-rigid box housing an article, on at least some of the external faces of which package there are provided illustrations of the appearance of the contents as though viewed from the respective direction.

1 Claim, 3 Drawing Sheets

MULTI-VIEW PACKAGING MATERIAL

This application claims the benefit of U.S. Provisional application Ser. No. 60/050,556, filed Jun. 23, 1997.

BACKGROUND OF THE INVENTION

FIELD OF THE INVENTION

The present invention relates generally to the construction, appearance, and utilisation of materials for the packaging of articles, e.g. for storage, transport and sale, for the purpose of giving the user or viewer of the packaged article an enhanced appreciation of the nature of the contents of the package.

OBJECTS OF THE INVENTION

It is a primary object of the present invention to provide a packaging material, and methods of formation of packages utilising such material, which impart to a package of the contents of the package when those contents are viewed from different angles, thereby facilitating appreciation of the nature of the contents, and its appearance from more that one angle, so as for example to enable a purchaser or store-keeper to select visually and immediately an article of a desired type, shape, size, operation or function, without having to undo or un-wrap various packages when making such a selection.

A second object of the invention is to provide a relatively rigid form of packaging material, capable of being formed into a self-sustaining package of rounded or faceted shape, on the of which there are provided a view, or views, of the contents when seen from different angles.

A third object of the invention is to provide a form of packaging sheet material which when wrapped about a self-sustaining container, such as a box or tube, will provide externally a view, or views, of the contents when seen from different angles.

BRIEF DESCRIPTION OF THE DRAWINGS

The foregoing and still other objects and advantages of the present invention will be more apparent form the detailed explanation of the preferred embodiments of the invention in connection with the accompanying drawings, wherein.

BRIEF DESCRIPTION OF THE PREFERRED EMBODIMENTS

Figure 1:
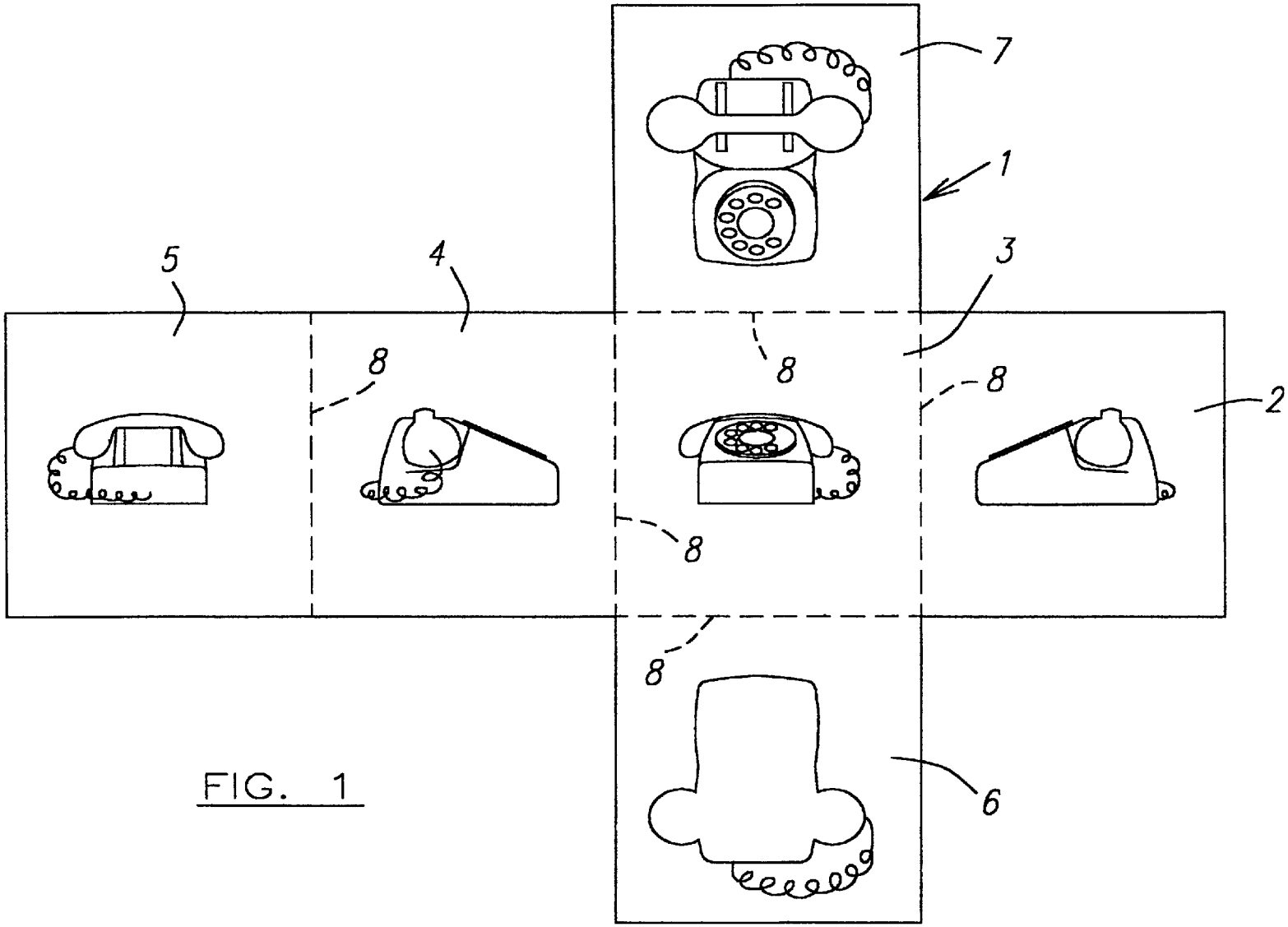
FIG. 1 is a plan view of a sheet of stiff or rigid packaging material in planar form, prior to being-folded up to form a cubic receptacle for an article such as the telephone illustrated.

Referring to FIG. 1 there is shown a plan view of a sheet of relatively stiff, or rigid, packaging material, for example, cardboard, fiberboard, wood veneer or other material as commonly used in the packaging art for the protection of articles for storage, transport, and sale, especially technical material such as electronic components. In this drawing, and in FIGS. 2 and 3 likewise, the 'article' to be packaged is shown for ease of understanding, as a conventional telephone.

In this figure of the drawings, the sheet 1 is pre-cut to the outline shown so as to have six square panels identified respectively by reference numerals 2, 3, 4, 5, 6, and 7. The sheet is preferably scored or otherwise relatively weakened along boundary lines 8 so that the panels can be bent up at right angles to each other. In forming the sheet 1 into a cubic package, the panels 2, 3, 4 and 5 are each bent at 90 degrees to the adjacent panel or panels, to form the eventual four sides of the cubic packages. The panel 7 is folded down to form the top of the eventual package, and the panel 6 is folded upwardly to form the underside of the eventual package. When the package is thus formed, and the contents, e.g. the telephone illustrated, are inserted in upright condition, the package will then reveal clearly to the user or prospective purchaser precisely what the of the contents will be, i.e. the package will show a top view of the telephone on panel 7, an underside view of the telephone on panel 6, and respective side, front, other side, and back views of the telephone on panels 2, 3, 4 and 5.

Clearly the panels could be releasably connected in any convenient manner to retain the package in its folded-up cubic form, e.g. tabs on edges of some panels and slots on edges of other panels, but these are not illustrated as they are well known in the art.

Figure 2:
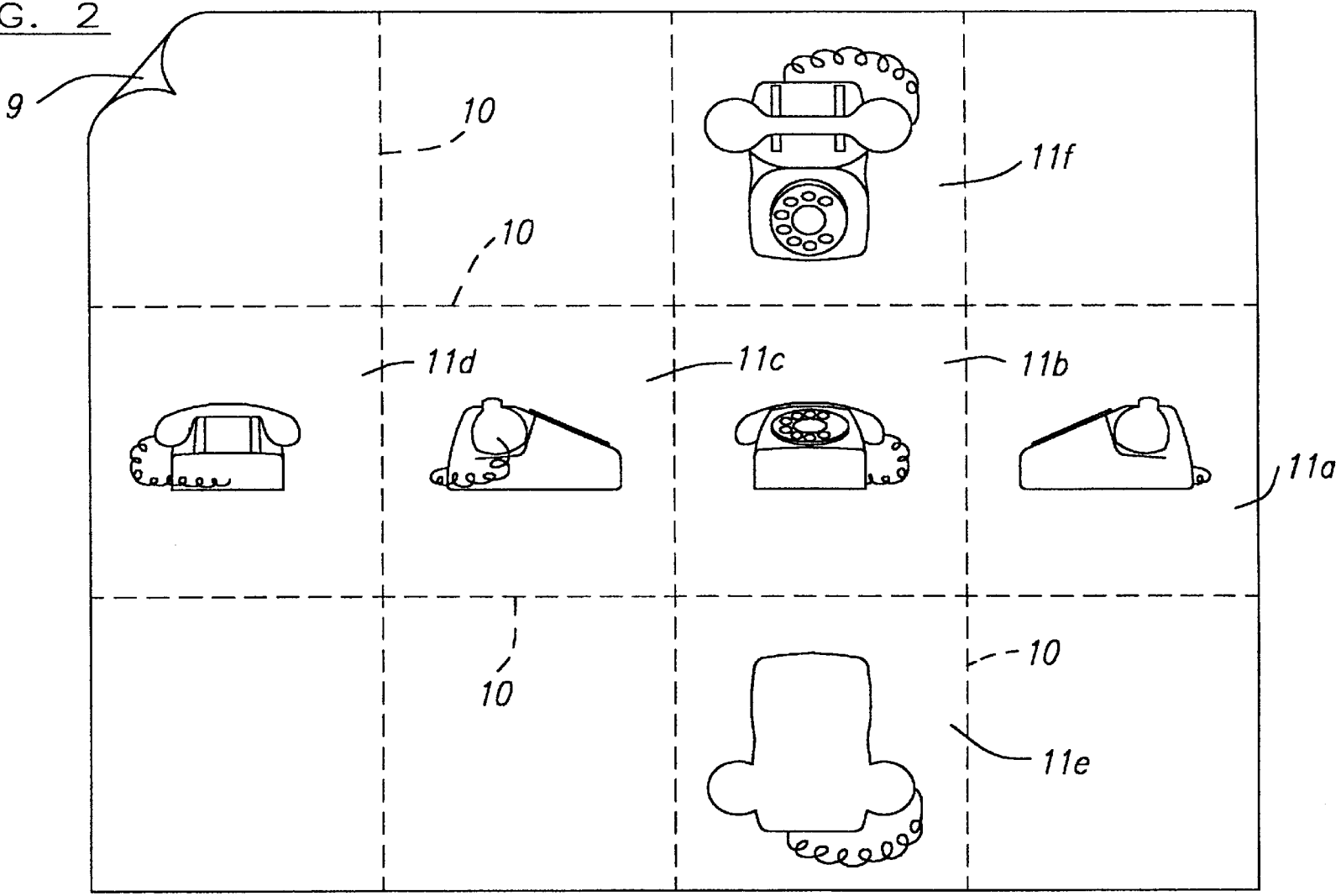
FIG. 2 is a plan view of a sheet of wrapping paper which can be folded about a cubic container in such a manner as to indicate the contents of the container.

Referring now to FIG. 2 of the drawings, there is shown a plan view of a sheet of foldable material, e.g. wrapping paper, plastic sheet, or foil which is flat stock material which may be taken, for example, form a continuous roll. The sheet 9 is rectangular, and is printed or otherwise marked with lines 10 to indicate the shape and extent of panels. Certain of these panels, i.e. 11*a*, 11*b*, 11*c*, 11*d*, 11*e* and 11*f* are marked respectively with side, front, other side, back, underside, and top views of the contents, i.e. the telephone shown by way of example. In use, the wrapping sheet would be used to wrap a cubic container, made of any convenient material but having the necessary cubic shape and dimensions to accord with the panels 11*a*, to 11*f*. The un-referenced panels not containing any illustration of the telephone would be either folded in such a manner as not to obstruct the appearance of the illustration of the other panels, or could be cut away at the time of forming the package. Again, with this manner of constructing a package, the eventual (wrapped) package will reveal to the user or purchaser precisely the appearance of the contents from all sides, top and underside.

Figure 3:
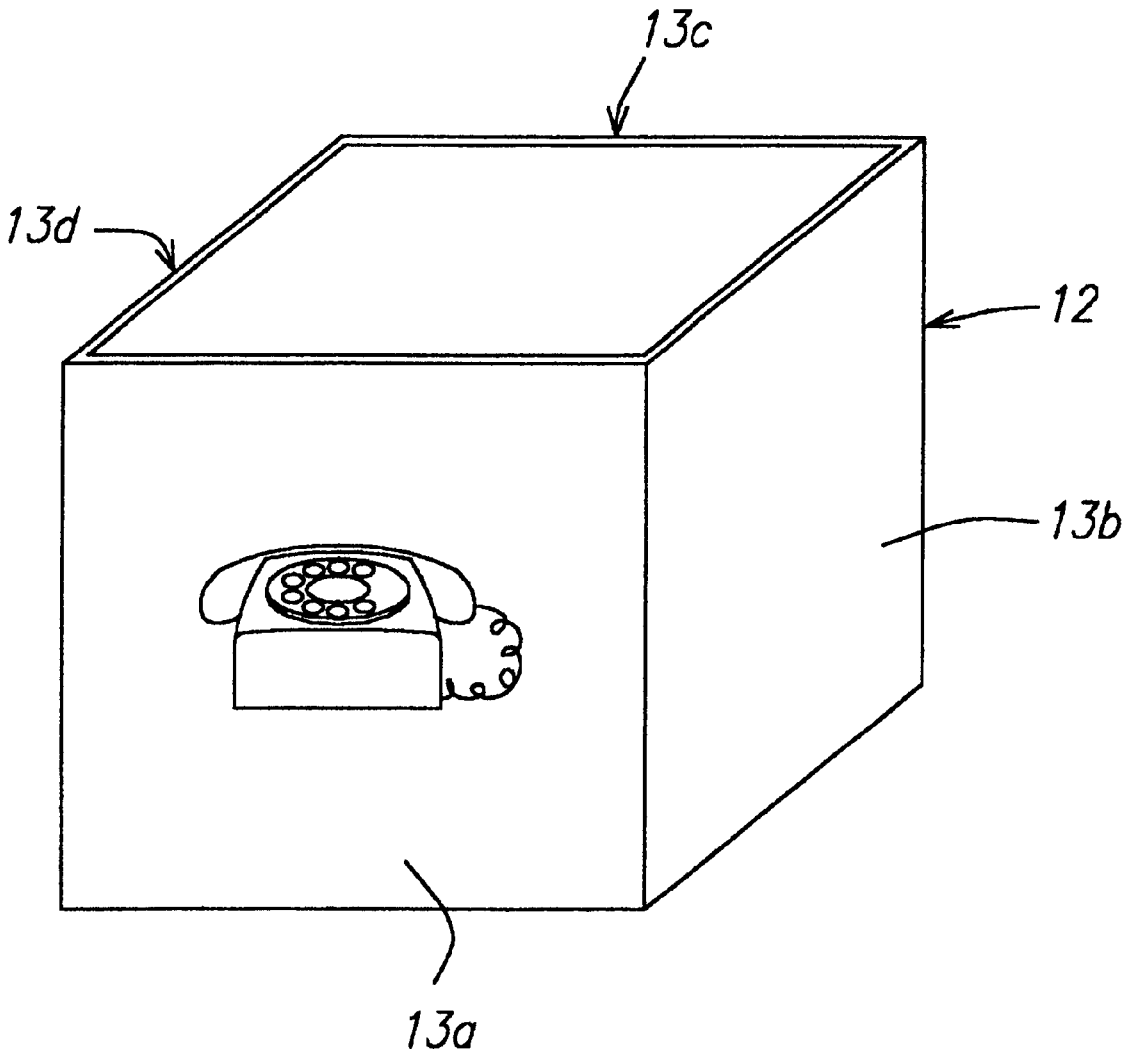
FIG. 3 is a perspective view of a sleeve of packaging material, or wrapping paper, which can be slid about a container in such a manner as to indicate and illustrate the contents of the container.

Referring now to FIG. 3, there is shown a further packaging material 12 which is in the form of a rectangular sleeve open at top and underside. The material 12 may be itself rigid enough to form a protective package, or it may be of flexible material, e.g. paper or plastic sheeting, and arranged to be slid over a rigid internal container such as a wooden, cardboard or plastic box. The eventual package, and thus the sleeve 12 utilised, need not necessarily be of cubic form, but could be generally rectangular as required. The sleeve has four panels 13*a*, 13*b*, 13*c* and 13*d*. The front panel 13*a* is provided with an illustration of the front view of the contents, i.e. the telephone shown. The other panels would be provided with respective illustrations (not shown in this perspective view) of one side (13*b*), a back view (13*c*), and the other side (13*d*) of the telephone.

It will be appreciated that the sleeve 12 of FIG. 3 could have more that four sides, e.g. it could have five, six, or more sides each marked with an appropriate view of the article as seen 'from that side position'. In the extreme case, for the accommodation of an elongated article of relatively small width, the sleeve could have an infinite number of sides, e.g. could be a tube of circular or oval cross-section appropriately marked with a single view of the article representing it as viewed from all round.

In these drawings, the article illustrated has been shown in all cases in direct 'head-on' views of the front, sides, rear, top and underside, but clearly perspective views could be used in all cases. Where the article is capable of development into an opened or otherwise modified condition, one or more of the views may show this.

What is claimed is:

1. The combination of:

a rigid package of sheet material, having sides, a top and a bottom forming external facts, displaying by illustrations on the opaque outside surface of said facets different views of contents within said package, which contents have a different appearance when viewed in a direction normal to the surface of each facet, and said illustrations showing views of the actual disposition, appearance, orientation and arrangement of said contents within and with respect to the facets of said package; and contents within said package enclosed by said package and said contents being arranged within said package in a particular orientation with respect to said facets of said package and corresponding in arrangement to the position of the illustrations displayed on said facets of said package.

* * * * *